US011639214B2

(12) United States Patent
Remmers

(10) Patent No.: US 11,639,214 B2
(45) Date of Patent: May 2, 2023

(54) CHAIN TENSIONER WITH CHAIN SWITCH DEVICE

(71) Applicant: STEVLOS B.V., Schiedam (NL)

(72) Inventor: Victor Maria Wilhelm Gerard Remmers, Schiedam (NL)

(73) Assignee: STEVLOS B.V.

( * ) Notice: Subject to any disclaimer, the term of this patent is extended or adjusted under 35 U.S.C. 154(b) by 302 days.

(21) Appl. No.: 17/272,575

(22) PCT Filed: Aug. 30, 2019

(86) PCT No.: PCT/NL2019/050559
§ 371 (c)(1),
(2) Date: Mar. 1, 2021

(87) PCT Pub. No.: WO2020/046127
PCT Pub. Date: Mar. 5, 2020

(65) Prior Publication Data

US 2021/0354788 A1 Nov. 18, 2021

(30) Foreign Application Priority Data

Aug. 30, 2018 (NL) ..... 2021529

(51) Int. Cl.
*B63B 21/50* (2006.01)
*B63B 21/20* (2006.01)

(52) U.S. Cl.
CPC ..... *B63B 21/50* (2013.01); *B63B 21/20* (2013.01); *B63B 2021/505* (2013.01)

(58) Field of Classification Search
CPC ... B63B 21/50; B63B 21/20; B63B 2021/505; B63B 21/18; B63B 21/22; B63B 21/04; B63B 21/08
See application file for complete search history.

(56) References Cited

U.S. PATENT DOCUMENTS 4,186,464 A 2/1980 Sandoy ..... 241/116
7,059,262 B2 * 6/2006 Dove ..... B63B 21/20 114/210
7,421,967 B1 9/2008 Fontenot et al. ..... 114/230.24

FOREIGN PATENT DOCUMENTS

EP 0 081 258 6/1983 ..... B63B 21/22
EP 1 318 072 6/2003 ..... B63B 21/50
(Continued)

OTHER PUBLICATIONS

Search Report issued in Netherlands Patent Appln. Serial No. NL2021529, dated May 7, 2019, 8 pages.
(Continued)

*Primary Examiner* — Anthony D Wiest
(74) *Attorney, Agent, or Firm* — Hayes Soloway P.C.

(57) ABSTRACT

Disclosed is a chain tensioner for employment on a bottom of a water body, wherein the chain tensioner is configured for adjustment of the length of a tensioning chain that extends between the chain tensioner and a floating offshore facility, wherein the chain tensioner includes a chain lock for engaging and confining a link of the tensioning chain in the chain passage from aside the tensioning chain, and a chain switch device having a chain guide for engaging the tensioning chain in the chain passage from aside the tensioning chain, wherein the chain guide is moveable between a first position in which the chain lock engages a link of the tensioning chain, and a second position in which the tensioning chain passes the chain lock.

19 Claims, 5 Drawing Sheets

(56) References Cited

FOREIGN PATENT DOCUMENTS

| | | | | |
|---|---|---|---|---|
| NO | 20170862 | 5/2017 | ..... | B63B 21/18 |
| WO | WO 2014/178721 | 11/2014 | ..... | B63B 21/50 |

OTHER PUBLICATIONS

International Preliminary Report on Patentability issued in PCT/NL2019/050559, dated Mar. 2, 2021, 7 pages.
International Search Report and Written Opinion issued in PCT/NL2019/050559, dated Nov. 26, 2019, 10 pages.

* cited by examiner

CHAIN TENSIONER WITH CHAIN SWITCH DEVICE

BACKGROUND

The invention relates to a chain tensioner for employment on a bottom of a water body. Such tensioner is configured for adjustment of the length of a tensioning chain that extends between the chain tensioner and a floating offshore facility, such as a Floating Production, Storage and Offloading (FPSO) facility, or a floating wind turbine for generating electricity offshore. Multiple chain tensioners and tensioning chains may be used, that are connected with mooring lines that are distributed around the floating offshore facility in a catenary configuration to secure the position with respect to the bottom of the water body.

A known chain tensioner for offshore application comprises a chain stopper for locking the tensioning chain with respect to the chain tensioner, and a gipsy wheel to guide the free end of the tensioning chain that is pulled away from the chain stopper by an anchor handling vessel to shorten the length of the tensioning chain between the chain tensioner and the floating offshore facility.

SUMMARY OF THE INVENTION

A disadvantage of the known chain tensioner is that the chain stopper is hard to handle from an anchor handling vessel. The chain stopper may be activated by making complex maneuvers, or it works like a one way ratchet mechanism that has to be released by employment of a remotely operated underwater vehicle (ROV). This is in particular disadvantageous for a newly installed floating offshore facility, as the mooring lines need to be re-tensioned after the initial time span of the service life.

It is an object of the present invention to provide a chain tensioner for employment on a bottom of a water body, which can be operated with control.

According to a first aspect, the invention provides a chain tensioner for employment on a bottom of a water body, wherein the chain tensioner is configured for adjustment of the length of a tensioning chain that extends between the chain tensioner and a floating offshore facility, wherein the tensioning chain comprises a series of connected links each having a main plane, wherein the links alternatingly have their main plane in a first orientation and in a second orientation that is under an angle with respect to the first orientation, wherein the chain tensioner comprises a frame that bounds a chain passage for the tensioning chain and that has a bottom wall or skid to stand on the bottom of the water body, a chain lock that is fixedly connected with the frame for engaging and confining a link of the tensioning chain in the chain passage from aside the tensioning chain, and a chain switch device comprising a chain guide for engaging the tensioning chain in the chain passage from aside the tensioning chain, wherein the tensioning chain is sidewardly moveable by means of the chain guide of the chain switch device by moving the chain guide with respect to the frame over a switching stroke between a first position in which the chain lock engages a link of the tensioning chain, and a second position in which the tensioning chain passes the chain lock.

The chain tensioner according to the invention is configured to be employed on a bottom of a water body, where it stands on by means of its bottom wall or skid. The chain tensioner remains permanently positioned on the bottom due to its own weight. The chain tensioner has a chain lock and a chain switch device with a chain guide that both engage the tensioning chain from aside. The chain tensioner can be locked and unlocked by toggling the chain switch device between the first position and second position, which moves the tensioning chain sideward with respect to the engaging chain lock. The chain switch device may be easy operated from a vessel, for example by connecting a pulling line to the chain switch device.

In an embodiment thereof the frame has with respect to the bottom wall or skid a front entrance of the chain passage at a front side of the frame, and a top entrance of the chain passage at a top side of the frame. The front entrance may be directed towards the floating offshore facility, while the top entrance is directed towards the water surface where a handing vessel pulls on the free end of the tensioning chain.

In an embodiment the chain switch device comprises a control cam between the frame and the chain guide, wherein the control cam is rotatable with respect to the frame between a first position and a second position, wherein in the first position of the chain switch device the cam and the chain guide are in their first position, and in the second position of the chain switch device the cam and the chain guide are in their second position. The control cam provides a control mechanism that can be operated even when marine fouling has been set on it, or when it has been penetrated by soil.

In an embodiment thereof the control cam is located above the chain passage, whereby it can be easily operated from a vessel on the water surface.

In an embodiment the chain switch device comprises a shackle on the control cam for connecting it with a pulling line, for example a pulling line of a vessel on the water surface.

In an embodiment the chain switch device comprises a first chain switch that is located with respect to the bottom wall or skid above the tensioning chain in the chain passage, wherein the first chain switch comprises a first chain guide that faces the chain passage, wherein the first chain switch is moveable with its first chain guide between a first position in which the first chain guide is aligned with the chain lock, and a second position in which the first chain guide is out of alignment with the chain lock. The first chain switch extends above the tensioning chain, whereby a sideward downward displacement of the tensioning chain is partly facilitated by the own weight of the tensioning chain.

In an embodiment thereof the first chain guide is convex curved towards the chain passage, whereby it can smoothly guide the tensioning chain when it is curved towards a vessel.

In an embodiment thereof the first chain guide curves in a direction from the front entrance to the top entrance.

In an embodiment the first chain switch is hingeable connected with the frame to hinge between its first position and second position. The hinge connection can be operated even when marine fouling has been set on it, or when it has been penetrated by soil.

In an embodiment the first chain switch comprises two first guide edges that extend parallel and spaced apart from each other to define a first link passage in between, wherein the first link passage has a width that allows passage of the links in their first orientation only, wherein the links in their second orientation slide along the first guide edges. The links that are in their first orientation are confined in sliding between the two guide edges to keep the links in their second orientation in contact with the first guide edges. In this manner the sliding movement of the tensioning chain along the first chain switch may be limited to the trajectory as defined by the first guide edges.

In a practical embodiment thereof the first chain switch comprises a plate shaped left switch body and a plate shaped right switch body having the first guide edges, wherein the left switch body and the right switch body are connected parallel and spaced apart from each other to define the first link passage in between.

In an embodiment the chain switch device comprises a second chain switch that is located with respect to the bottom wall or skid below the tensioning chain in the chain passage, wherein the second chain switch comprises a second chain guide that faces the chain passage, wherein the second chain switch is moveable with its second chain guide between a first position in which the second chain guide is aligned with the chain lock, and a second position in which the second chain guide is out of alignment with the chain lock. The second chain switch extends below the tensioning chain, whereby the tensioning chain may partly lie onto the second chain switch under its own weight to facilitate a sideward displacement of the tensioning chain.

In an embodiment thereof the second chain guide is convex curved towards the chain passage.

In an embodiment the second chain switch is hingeable connected with the frame to hinge between its first position and second position. The hinge connection can be operated even when marine fouling has been set on it, or when it has been penetrated by soil.

In an embodiment the second chain switch comprises two second guide edges that extend parallel and spaced apart from each other to define a second link passage in between, wherein the second link passage has a width that allows passage of the links in their first orientation only, wherein the links in their second orientation slide along the second guide edges. In this manner the sliding movement of the tensioning chain along the second chain switch may be limited to the trajectory as defined by the second guide edges.

In a practical embodiment thereof the second chain switch comprises a plate shaped left switch body and a plate shaped right switch body having the second guide edges, wherein the left switch body and the right switch body are connected parallel and spaced apart from each other to define the second link passage in between.

In an embodiment the chain lock comprises two hook sections that are fixed to the frame and that project from the frame into the chain passage, wherein the hook sections extend spaced apart from each other to define a link passage in between, wherein the link passage has a width that allows passage of the links in their first orientation only, wherein the hook sections engage the links in their second orientation. The tensioning chain is positioned with respect to the chain lock by the links in their first orientation, whereby the two hook sections can reliably engage the first entering link in its second orientation on both sides of it.

In an embodiment the hook sections each comprise a catch aperture for confinement of the engaged link.

In a combined embodiment the chain switch device comprises a connecting yoke between the first chain switch and the second chain switch for synchronous movement of the first chain switch and the second chain switch.

In an embodiment thereof the control cam is operatively connected with the first chain switch and the second chain switch.

According to a second aspect, the invention provides a method for operating a chain tensioner for employment on a bottom of a water body, wherein the chain tensioner is configured for adjustment of the length of a tensioning chain that extends between the chain tensioner and a floating offshore facility, wherein the tensioning chain comprises a series of connected links each having a main plane, wherein the links alternatingly have their main plane in a first orientation and in a second orientation that is under an angle with respect to the first orientation, wherein the chain tensioner comprises a frame that bounds a chain passage for the tensioning chain and that has a bottom wall or skid to stand on the bottom of the water body, a chain lock that is fixedly connected with the frame for engaging and confining a link of the tensioning chain in the chain passage from aside the tensioning chain, and a chain switch device comprising a chain guide for engaging the tensioning chain in the chain passage from aside the tensioning chain, wherein the tensioning chain is sidewardly moveable by means of the chain guide of the chain switch device by moving the chain guide with respect to the frame over a switching stroke between a first position in which the chain lock engages a link of the tensioning chain, and a second position in which the tensioning chain passes the chain lock, wherein the tensioning chain has an operational tensioning chain section that extends between the chain tensioner and the floating offshore facility, and an adjustment chain section that extends freely from the chain tensioner, wherein the method comprises the step of picking up the adjustment chain section, switching the chain guide of the chain switch device into its second position, pulling on the adjustment chain section, whereby the chain lock releases the tensioning chain and the tension chain slides through the chain passage, and switching the chain guide of the chain switch device into its first position, whereby the chain lock engages a link of the tensioning chain.

In an embodiment thereof the adjustment chain section is pulled upwards while the chain tensioner remains in contact with the bottom of the water body.

The various aspects and features described and shown in the specification can be applied, individually, wherever possible. These individual aspects, in particular the aspects and features described in the attached dependent claims, can be made subject of divisional patent applications.

BRIEF DESCRIPTION OF THE DRAWINGS

The invention will be elucidated on the basis of an exemplary embodiment shown in the attached drawings, in which.

DETAILED DESCRIPTION OF THE INVENTION

Figure 1A:
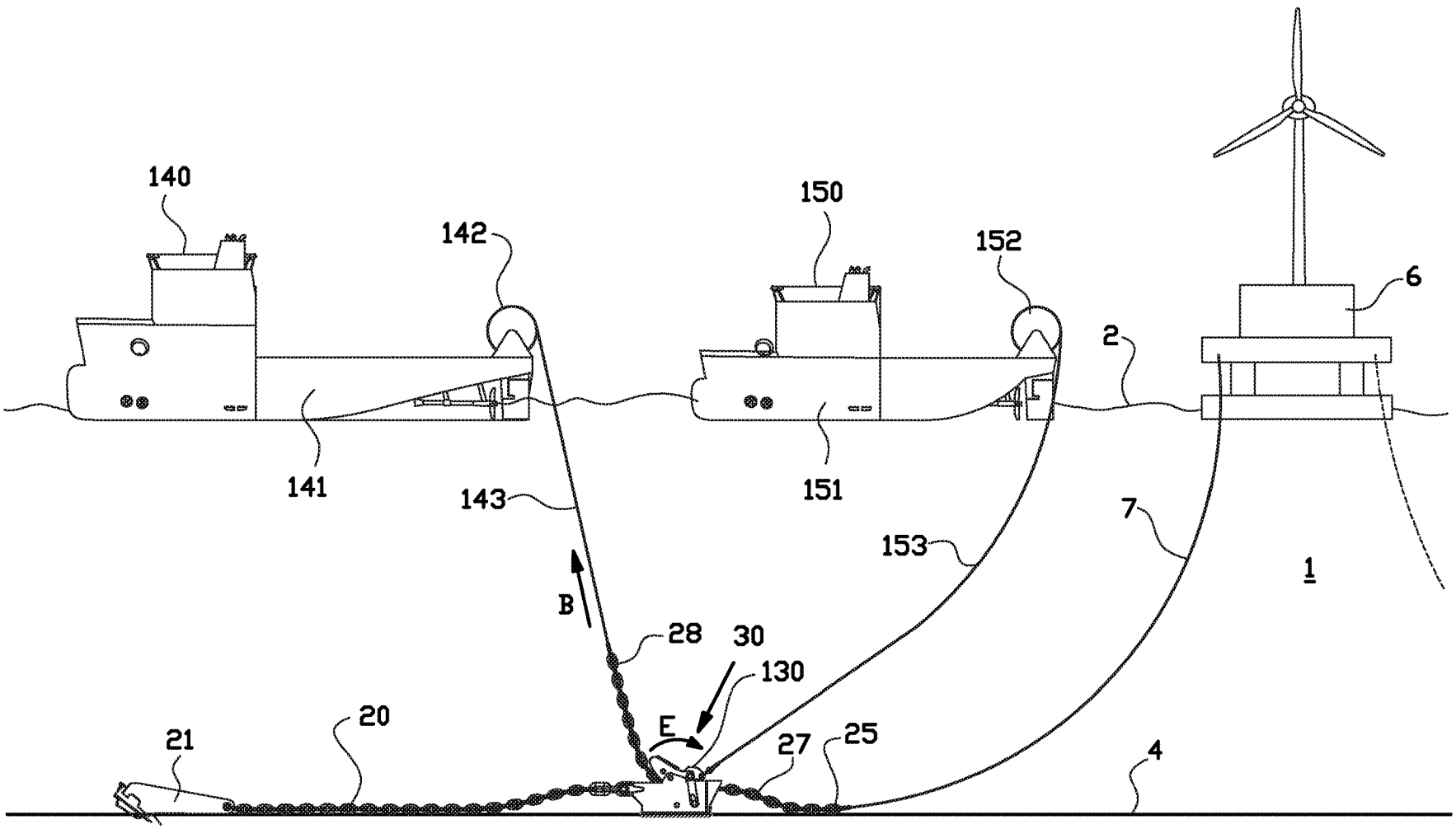
FIGS. 1A and 1B show an offshore setup having a floating offshore facility that is anchored to a sea bottom by means of an anchor, with a chain tensioner according to an embodiment of the invention interposed that is shown in its unlocked and in its locked position, respectively.
Figure 1B:
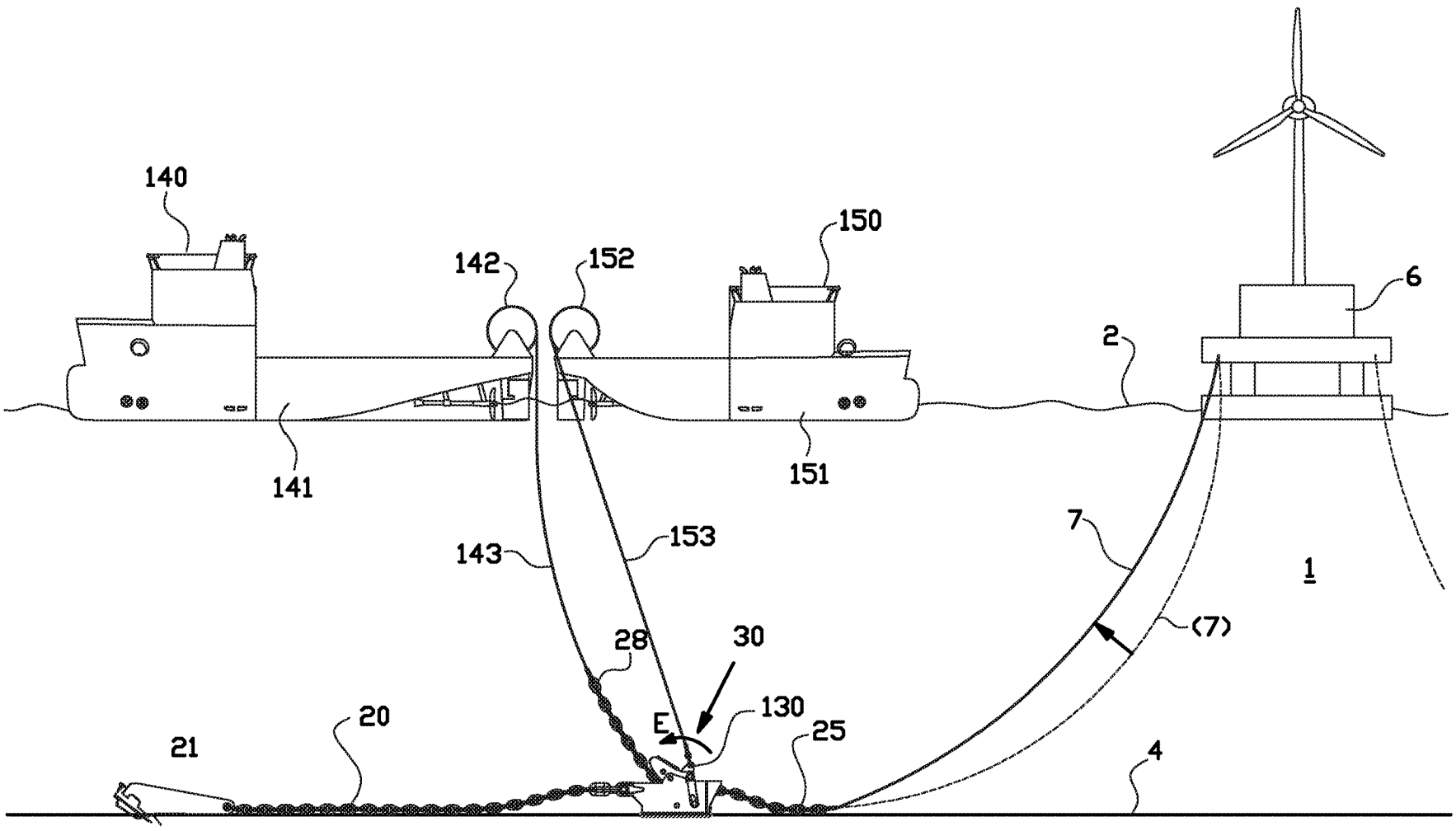

FIGS. 1A and 1B show an offshore setup in a water body, in this example a sea 1, above a water body bottom, in this example a seabed 3. The offshore setup is configured with a floating offshore facility at the level of the water surface 2, such as a Floating Production, Storage and Offloading (FPSO) facility, or a floating wind turbine 6 for generating electricity offshore as shown in FIGS. 1A and 1B. The floating wind turbine 6 is connected to multiple mooring lines that are distributed around it to form a plurality of catenaries to secure the position of the wind turbine 6 with respect to the seabed 3. For illustrative purposes the FIGS. 1A and 1B show only one mooring line 7 thereof. The water is relatively shallow, but for illustrative purposes a notional steep catenary configuration of the mooring line 7 is shown.

The mooring line 7 is a rope based on a synthetic fiber, for example polyethylene (PE) or Dyneema®, but alternatively a traditional steel cable may be used. The mooring line 7 is connected with a steel tensioning chain 25 that due to its high own weight normally rests on the sea floor 3 over practically its entire length, even when sideward wind forces act on the wind turbine 6. The tensioning chain 25 is fed through a chain tensioner 30 according to an embodiment of the invention that rests on the upper surface 4 of the seabed 3. The chain tensioner 30 is anchored to the sea bed 3 by means of a heavy marine anchor 21 that is connected therewith via a steel anchor chain 20. The heavy duty marine anchor 21 is for example a 10-30 tons marine anchor, such as the Vryhof Stevpris MK6 30-tons anchor. The chain tensioner 30 is destined for to remain positioned on the sea floor 3, that is, during the operational lifespan of the floating wind turbine 6 or the marine anchor 21, except on extreme cases where it can be temporary lifted by the mooring line 7 itself.

Figure 2A:
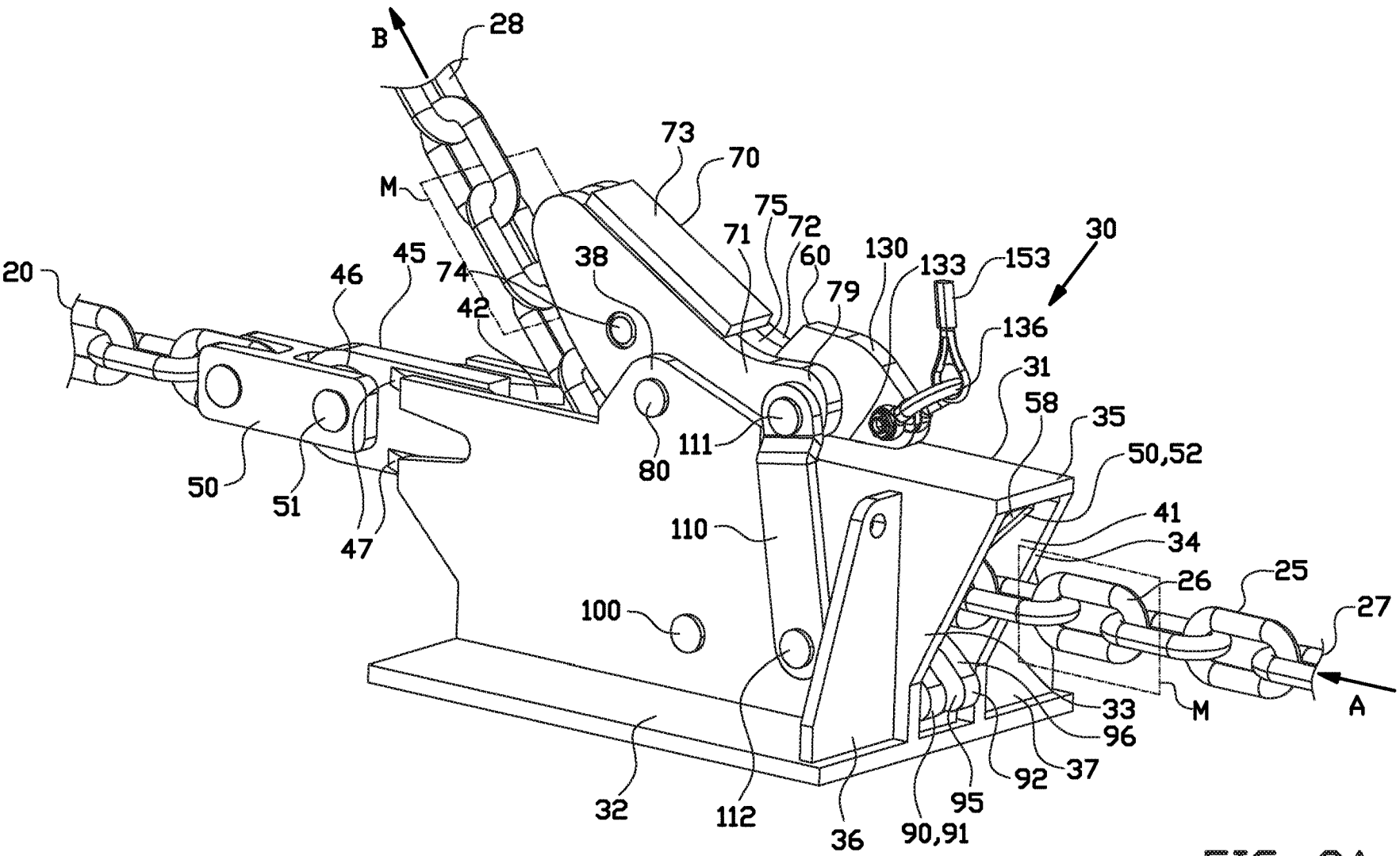
FIGS. 2A and 2B are respectively an isometric view of the chain tensioner in its unlocked position as shown in FIG. 1A, and a side view thereof wherein some parts have been removed for illustrative purposes.
Figure 2B:
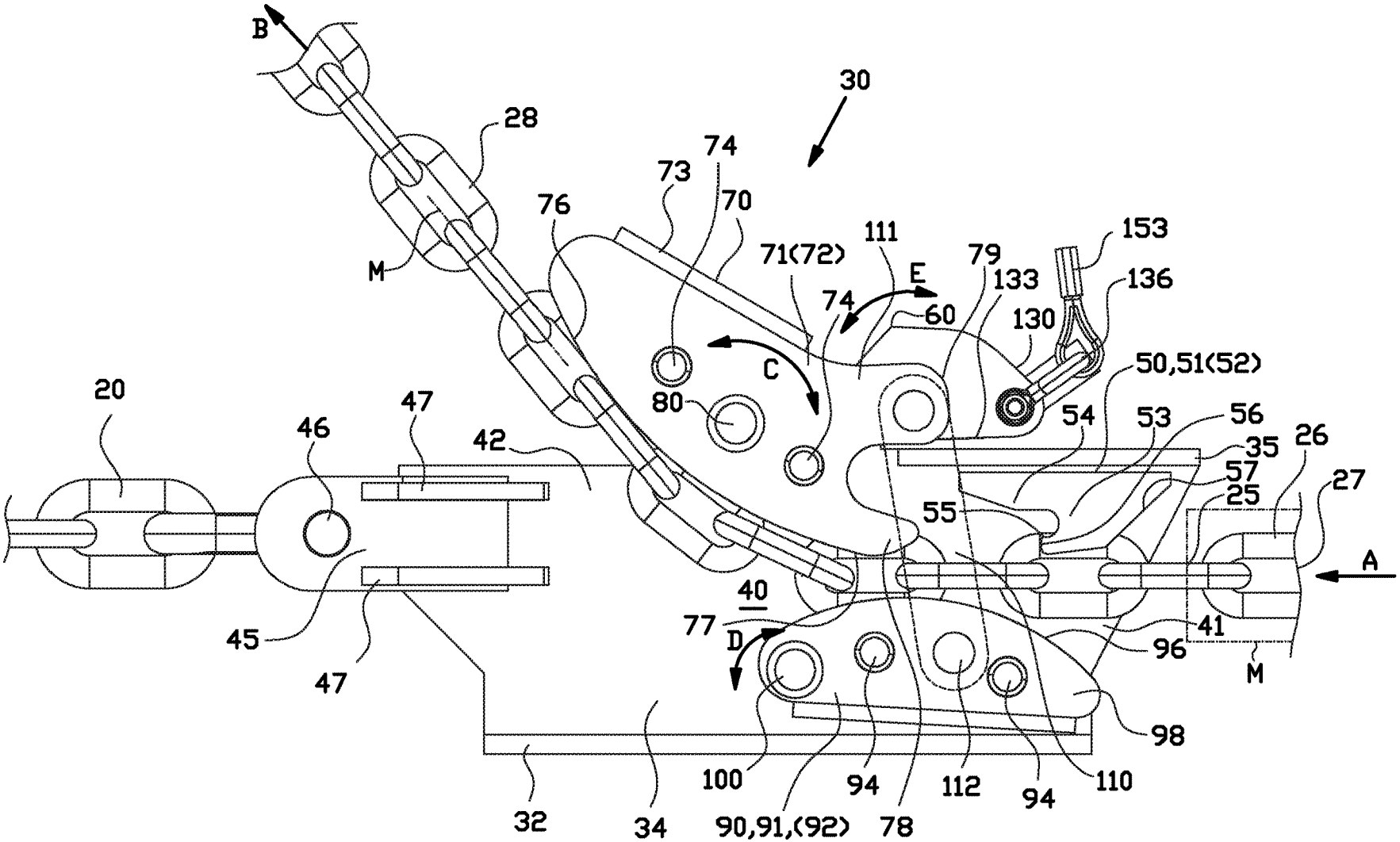
Figure 3:
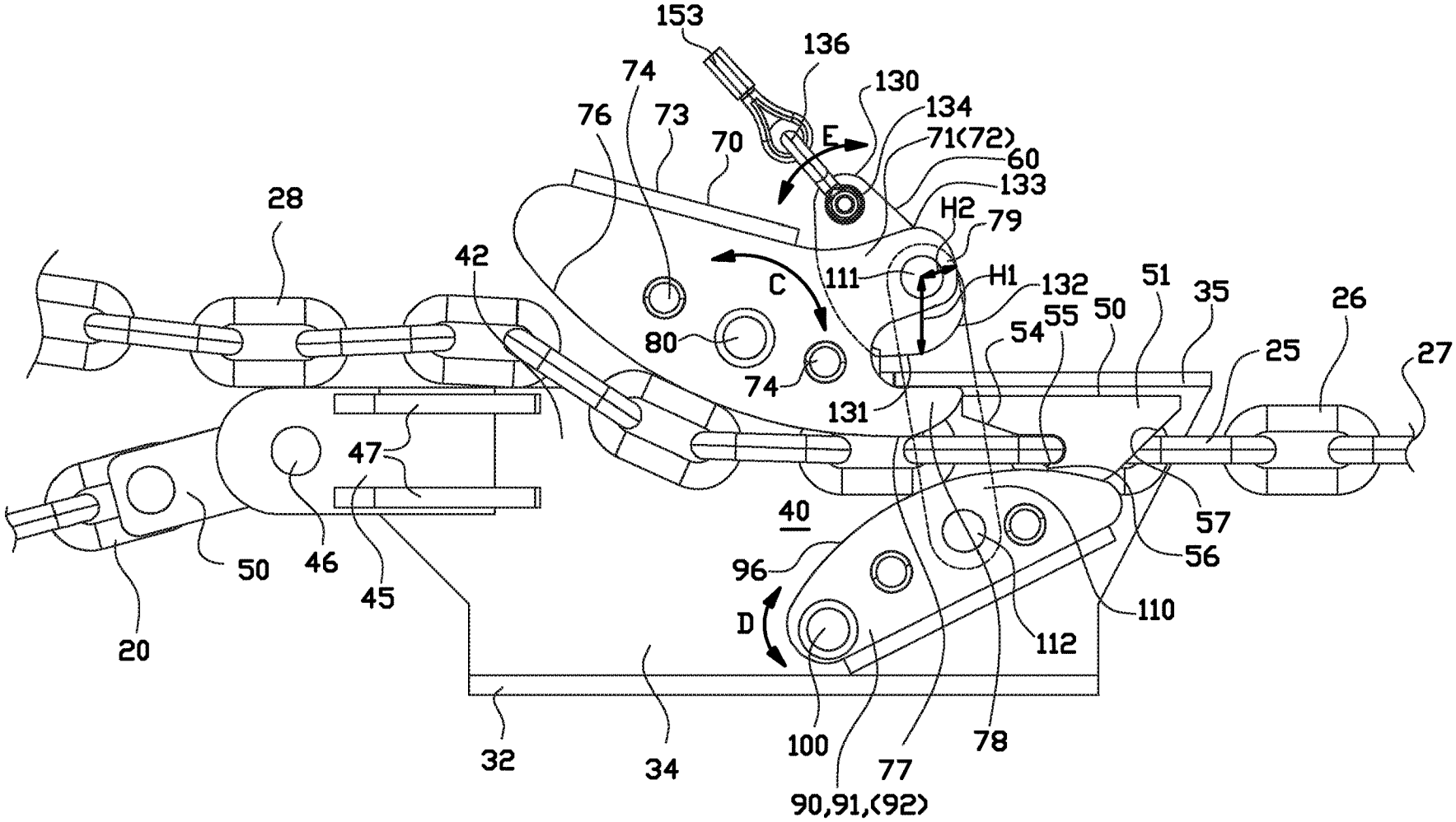
FIG. 3 is a side view of the chain tensioner in its locked position as shown in FIG. 1B, wherein some parts have been removed for illustrative purposes.

As shown in FIGS. 2A, 2B and 3, the tensioning chain 25 comprises a series of connected ring shaped or donut shaped steel links 26 each having a main plane M that is equal to the plane of symmetry. The links 26 have with respect to the notional center line of the anchor chain 25 alternatingly a first orientation and a second orientation in which the main planes M thereof are oriented under right angles with respect to each other, in particular when the tensioning chain 25 is under tension. In this example the links 26 have in the first orientation their main plain practically upright, and in the second orientation practically horizontal. The chain tensioner 30 divides the tensioning chain 25 in two notional chain sections. The operational tensioning chain section 27 thereof extends between the chain tensioner 30 and the mooring line 7, and the not operational adjustment chain section 28 thereof extends freely from the chain tensioner 30.

As best shown in FIG. 2A, the chain tensioner 30 comprises a steel frame 31 that is made of steel plate elements, comprising a skid or bottom wall 32 with a rectangular outline, and a left sidewall 33 and a right sidewall 34 that extend upright and parallel to each other from the bottom wall 32. The left sidewall 33 and the right sidewall 34 have the same outline and are connected to each other with a top wall 35 that extends parallel to the bottom wall 32. The left sidewall 33 and the right sidewall 34 are sideways stiffened by means of a left front wall 36 and a right front wall 37, respectively, that extend perpendicular thereto. The bottom wall 32, the left sidewall 33, the right sidewall 34 and the top wall 35 together bound an internal chain passage 40 having a front entrance 41 and a top entrance 42 for the tensioning chain 25.

As shown in FIGS. 2A, 2B and 3, the chain tensioner 30 comprises a steel anchoring lug 45 that is welded between the back ends of the left sidewall 33 and the right sidewall 34 via steel intermediate ribs 47. The anchoring lug 45 comprises an end eye 46 that extends beyond the left sidewall 33 and right sidewall 34. The anchor chain 20 is connected with the chain tensioner 30 by means of a steel shackle 50 having its mounting pin or mounting bolt 51 through the eye 46.

As shown in FIGS. 2A, 2B and 3, the chain tensioner 30 comprises a steel chain lock 50 inside the chain passage 40. The chain lock 50 comprises a plate shaped left hook body 51 and a plate shaped right hook body 52 that are welded parallel to each other against the left sidewall 33 and the right sidewall 34, respectively. The left hook body 51 and the right hook body 52 have the same outline, having a catch aperture 53 that upwardly merges into a first guide edge 54 and that downwardly merges into a shorter hook edge 55 on a projecting hook section 56. The catch aperture 53 debouches inside the chain passage 40 in the direction away from the front entrance 41, wherein the first guide edge 54 and the hook edge 55 subsequently diverge from the catch aperture 53 into the chain passage and towards the top entrance 42. The hook section 56 comprises a frontal second guide edge 57 that extends from the top plate 35 obliquely into the chain passage 40. The left hook body 51 and the right hook body 52 are positioned spaced apart from each other to define a link passage 58 in between, having a width that allows loose passage of the links 26 in their first orientation only. Only in the second orientation the links 26 enter and fit loosely in the catch apertures 53.

As shown in FIGS. 2A, 2B and 3, the chain tensioner 30 comprises a steel chain switch device 60 for positioning the tensioning chain 25 with respect to the chain lock 50. The chain switch device 60 comprises a first chain switch 70 that is located on top and partly inside the frame 31, a second chain switch 90 that is located fully inside the frame 31, two external connecting yokes 110 between the chain switches 70, 90 and a control cam 130 to position the chain switches 70, 90 with respect to the frame 31. The first chain switch 70 and the second chain switch 90 form chain guides of the chain tensioner 30.

The first chain switch 70 comprises a plate shaped left switch body 71 and a plate shaped right switch body 72 that are welded parallel and spaced apart from each other to a top plate 73 and to two spacer pins 74. The left switch body 71 and the right switch body 72 have the same outline, having a fluently curved first guide edge 76 that extends through the top entrance 42 of the frame 31 and that is convex towards the chain passage 40, an end lug 78 that extends below the top wall 35 of the frame 31, and a control lug 79 that extend above the top wall 35 of the frame 31. The first chain switch 70 is hingeably connected to projecting top lugs 38 of the left sidewall 33 and the right sidewall 34 by means of a hinge pin 80.

The left switch body 71 and the right switch body 72 of the first chain switch 70 define a first link passage 75 in between, having a width that allows loose passage of the links 26 in their first orientation only. Only in their second orientation the links 26 slide along and over the curved first guide edges 76. The first chain switch 70 can toggle in direction C between a first position as shown in FIG. 3 in which the first guide edge 76 on the end lug 78 is vertically aligned with the catch apertures 53, and a second position as shown in FIGS. 2A and 2B in which the first guide edge 76 on the end lug 78 extends fully below the projecting hook sections 56.

The second chain switch 90 comprises a plate shaped left switch body 91 and a plate shaped right switch body 92 that are welded parallel and spaced apart from each other to two spacer pins 94. The left switch body 91 and the right switch body 92 have the same outline, having a fluently curved second guide edge 96 that ends at a front side 98 of the body that is located at the front entrance 41 of the frame 31. The second guide edge 96 is convex towards the chain passage 40. The second chain switch 90 is hingeably connected to the left sidewall 33 and the right sidewall 34 by means of a hinge pin 100.

The left switch body 91 and the right switch body of the second chain switch 90 define a second link passage 95 in between, having a width that allows loose passage of the links 26 in their first orientation only. Only in their second orientation the links 26 slide along and over the curved second guide edges 96. The second chain switch 90 can toggle in direction D between a first position as shown in FIG. 3 in which the second guide edge 96 on the front side 98 is vertically aligned with the catch apertures 53, and a second position as shown in FIGS. 2A and 2B in which the front side 77 of the guide edge extends fully below the projecting hook sections 56.

As shown in FIGS. 2A, 2B and 3, the control lugs 79 of the first chain switch 70 are via a first hinge pin 111 hingeably connected with the upper ends of the connecting yokes 110. The second chain switch 90 is via a second hinge pin 112 hingeably connected to the lower ends of the connecting yokes 110. The first hinge pin 111 also hingeably connects the control cam 130 with the first chain switch 70.

As best shown in FIG. 3, the control cam 130 comprises a first practically straight first abutment edge 131 at a first distance H1 with respect to the center of the first hinge pin 111. The first abutment edge 131 merges via a convex guide edge 132 into a practically straight second abutment edge 133 at a second distance H2 with respect to the center of the first hinge pin 111, wherein the second distance H2 is smaller than the first distance H1. The control cam 130 comprises oppositely to the first abutment edge 131 an end eye 134 with a shackle 136. By manipulating at the shackle 136, the control cam 130 can toggle between a first position as shown in FIG. 3 in which the first abutment edge 131 abuts the top wall 35 of the frame 31, and a second position as shown in FIGS. 2A and 2B in which the second abutment edge 133 abuts the top wall 35 of the frame 31. For illustrative purposes the abutting first abutment edge 131 and second abutment edge 133 are shown spaced apart from the top wall 35.

The control cam 130 is used to change the chain tensioner 30 between a locked position and a unlocked position for the tensioning chain 25. In the locked position of the chain tensioner 30 as shown in FIG. 3, the control cam 130 is in its first position, whereby it keeps the first chain switch 70 and via the connecting yokes 110 the second chain switch 90 in their first positions. In the unlocked position of the chain tensioner 30 as shown in FIGS. 2A and 2B, the control cam 130 is in its second position, whereby the first chain switch 70 and via the connecting yokes 110 the second chain switch 90 are allowed to fall down to their second positions. It is possible to apply a small lost motion between the first chain switch 70 and the second chain switch 90, for example by using elongate slots instead of round holes for the first hinge pin 111. This facilitates that one of the first chain switch 70 and second chain switch 90 is operated first. This can be advantageous when the switches 70, 90 are stuck due to marine fouling or ingress of soil.

FIGS. 1A and 1B show the offshore operations when the mooring line 7 is tensioned or re-tensioned. Re-tensioning is for example necessary to compensate slack that has been caused by initial relief that originates from the manufacturing process of the mooring line 7. The operations are performed by using an anchor handling vessel 140 comprising a first hull 141 with a first winch 142 around which a first pulling line 143 is wound, and an auxiliary anchor handling vessel 150 comprising a second hull 151 with a second winch 152 around which a second pulling line 153 is wound. The chain tensioner 30 stands in its locked position on the seabed, having the control cam 130 in its upright, first position.

In this example the operations are performed by the two distinct vessels 140, 150. However, the operations may also be performed by the anchor handling vessel 140 only, having both the first winch 142 and the second winch 152.

As a first step as shown in FIG. 1A, the adjustment chain section 28 of the tensioning chain 25, which lies freely on the surface 4 of the seabed 3 is picked up and attached to the first pulling line 143, for example by means of a not shown remotely operated underwater vehicle (ROV). In the same manner the second pulling line 153 is attached to the shackle 136 of the control cam 130.

As a second step, the second anchor handling vessel 150 with its second pulling line 153 is maneuvered such that the control cam 130 is toggled in direction E from its first position into its second position. Hereby the chain tensioner 30 changes into its unlocked position, wherein the first guide edge 76 guides the tensioning chain 25 inside the inner passage 40 downwards away from the chain lock 50 while the second guide edge 96 retracts over the same stroke from the chain lock 50. By the pulling on the first pulling line 143 in pulling direction B, the link that is engaged in the catch apertures 53 is then released and the entire tensioning chain 25 moves in direction A through the chain tensioner 30 until the desired tension in the mooring line 7 or the desired length is reached for the mooring line 7. During this operation, the tensioning chain 25 is smoothly guided upwards by the first guide edges 76 of the first chain switch 70.

As a third step, as shown in FIG. 1B, the auxiliary vessel 150 with its second pulling line 153 is maneuvered such that the control cam 130 is toggled back in direction E from its second position into its first position. Hereby the first chain switch 70 and the second chain switch 90 move into their first position, whereby the second guide edges 96 urge the tensioning chain 25 into the chain lock 50. By paying out the first pulling line 143 over a small stroke, the first link 26 in the second orientation that abuts the first guide edges 54 of the chain lock 50 becomes engaged in the catch apertures 53. The pulling lines 143, 153 can then be disconnected and hauled in.

When above-described operations are performed only by the anchor handling vessel 140 having both the first winch 142 and the second winch 152, the attached first pulling line 143 is initially kept slack while the anchor handling vessel 140 maneuvers to pull and toggle the control cam 130 into its second position. Thereafter the anchor handling vessel 140 maneuvers into its position as shown in FIG. 1B in which it can pull with the first pulling line 143 on the tensioning chain 25. When the desired length is reached for the mooring line 7, the second pulling line 153 is pulled simultaneously to toggle the control cam 130 back in direction E into its first position.

The chain tensioner 30 according to the invention is configured to remain on the seabed 3 during use and during the entire above described tensioning or re-tensioning operation.

It is to be understood that the above description is included to illustrate the operation of the preferred embodiments and is not meant to limit the scope of the invention. From the above discussion, many variations will be apparent to one skilled in the art that would yet be encompassed by the scope of the present invention.

The invention claimed is:

1. A chain tensioner for employment on a bottom of a water body, wherein the chain tensioner is configured for adjustment of the length of a tensioning chain that extends between the chain tensioner and a floating offshore facility, wherein the tensioning chain comprises a series of connected links each having a main plane, wherein the links alternatingly have their main plane in a first orientation and in a second orientation that is under an angle with respect to the first orientation, wherein the chain tensioner comprises a frame that bounds a chain passage for the tensioning chain and that has a bottom wall or skid to stand on the bottom of the water body, a chain lock that is fixedly connected with the frame for engaging and confining a link of the tensioning chain in the chain passage from aside the tensioning chain, and a chain switch device comprising a chain guide for engaging the tensioning chain in the chain passage from aside the tensioning chain, wherein the tensioning chain is sidewardly moveable by the chain guide of the chain switch device by moving the chain guide with respect to the frame over a switching stroke between a first position in which the chain lock engages a link of the tensioning chain, and a second position in which the tensioning chain passes the chain lock.

2. The chain tensioner according to claim 1, wherein the frame has with respect to the bottom wall or skid a front entrance of the chain passage at a front side of the frame, and a top entrance of the chain passage at a top side of the frame.

3. The chain tensioner according to claim 1, wherein the chain switch device comprises a control cam between the frame and the chain guide, wherein the control cam is rotatable with respect to the frame between a first position and a second position, wherein in the first position of the chain switch device the cam and the chain guide are in their first position, and in the second position of the chain switch device the cam and the chain guide are in their second position.

4. The chain tensioner according to claim 3, wherein the control cam is located above the chain passage.

5. The chain tensioner according to claim 3, wherein the chain switch device comprises a shackle on the control cam for connecting it with a pulling line.

6. The chain tensioner according to claim 1, wherein the chain switch device comprises a first chain switch that is located with respect to the bottom wall or skid above the tensioning chain in the chain passage, wherein the first chain switch comprises a first chain guide that faces the chain passage, wherein the first chain switch is moveable with its first chain guide between a first position in which the first chain guide is aligned with the chain lock, and a second position in which the first chain guide is out of alignment with the chain lock.

7. The chain tensioner according to claim 6, wherein the first chain guide is convex curved towards the chain passage.

8. The chain tensioner according to claim 6, wherein the first chain switch is hingeable connected with the frame to hinge between its first position and second position.

9. The chain tensioner according to claim 6, wherein the first chain switch comprises two first guide edges that extend parallel and spaced apart from each other to define a first link passage in between, wherein the first link passage has a width that allows passage of the links in their first orientation only, wherein the links in their second orientation slide along the first guide edges.

10. The chain tensioner according to claim 9, wherein the first chain switch comprises a plate shaped left switch body and a plate shaped right switch body having the first guide edges, wherein the left switch body and the right switch body are connected parallel and spaced apart from each other to define the first link passage in between.

11. The chain tensioner according to claim 1, wherein the chain switch device comprises a second chain switch that is located with respect to the bottom wall or skid below the tensioning chain in the chain passage, wherein the second chain switch comprises a second chain guide that faces the chain passage, wherein the second chain switch is moveable with its second chain guide between a first position in which the second chain guide is aligned with the chain lock, and a second position in which the second chain guide is out of alignment with the chain lock.

12. The chain tensioner according to claim 11, wherein the second chain guide is convex curved towards the chain passage.

13. The chain tensioner according to claim 12, wherein the second chain switch is hingeable connected with the frame to hinge between its first position and second position.

14. The chain tensioner according to claim 11, wherein the second chain switch comprises two second guide edges that extend parallel and spaced apart from each other to define a second link passage in between, wherein the second link passage has a width that allows passage of the links in their first orientation only, wherein the links in their second orientation slide along the second guide edges.

15. The chain tensioner according to claim 14, wherein the second chain switch comprises a plate shaped left switch body and a plate shaped right switch body having the second guide edges, wherein the left switch body and the right switch body are connected parallel and spaced apart from each other to define the second link passage in between.

16. The chain tensioner according to claim 1, wherein the chain lock comprises two hook sections that are fixed to the frame and that project from the frame into the chain passage, wherein the hook sections extend spaced apart from each other to define a link passage in between, wherein the link passage has a width that allows passage of the links in their first orientation only, wherein the hook sections engage the links in their second orientation.

17. The chain tensioner according to claim 16, wherein the hook sections each comprise a catch aperture for confinement of the engaged link.

18. A method for operating a chain tensioner for employment on a bottom of a water body, wherein the chain tensioner is configured for adjustment of the length of a tensioning chain that extends between the chain tensioner and a floating offshore facility, wherein the tensioning chain comprises a series of connected links each having a main plane, wherein the links alternatingly have their main plane in a first orientation and in a second orientation that is under an angle with respect to the first orientation, wherein the chain tensioner comprises a frame that bounds a chain passage for the tensioning chain and that has a bottom wall or skid to stand on the bottom of the water body, a chain lock that is fixedly connected with the frame for engaging and confining a link of the tensioning chain in the chain passage from aside the tensioning chain, and a chain switch device comprising a chain guide for engaging the tensioning chain in the chain passage from aside the tensioning chain, wherein the tensioning chain is sidewardly moveable by the chain guide of the chain switch device by moving the chain guide with respect to the frame over a switching stroke between a first position in which the chain lock engages a link of the tensioning chain, and a second position in which the tensioning chain passes the chain lock, wherein the tensioning chain has an operational tensioning chain section that extends between the chain tensioner and the floating offshore facility, and an adjustment chain section that extends freely from the chain tensioner, wherein the method comprises the step of picking up the adjustment chain section, switching the chain guide of the chain switch device into its second position, pulling on the adjustment chain section, whereby the chain lock releases the tensioning chain and the tension chain slides through the chain passage, and switching the chain guide of the chain switch device into its first position, whereby the chain lock engages a link of the tensioning chain.

19. The method according to claim 18, wherein the adjustment chain section is pulled upwards while the chain tensioner remains in contact with the bottom of the water body.

* * * * *